United States Patent [19]

Iizuka et al.

[11] 4,305,365

[45] Dec. 15, 1981

[54] ELECTRONIC CONTROLLED FUEL INJECTION SYSTEM

[75] Inventors: Haruhiko Iizuka, Yokosuka; Fukashi Sugasawa, Yokohama; Junichiro Matsumoto, Yokosuka, all of Japan

[73] Assignee: Nissan Motor Company, Limited, Yokohama, Japan

[21] Appl. No.: 81,920

[22] Filed: Oct. 4, 1979

[30] Foreign Application Priority Data

Apr. 10, 1978 [JP] Japan ..... 53-136465[U]

[51] Int. Cl.[3] ..... F02B 3/00

[52] U.S. Cl. ..... 123/493; 123/492; 123/325

[58] Field of Search ..... 123/198 DB, 493, 492, 123/478, 325; 192/4 A, 4 R, 3 R; 74/865, 866, 872, 877; 180/271, 284, 287

[56] References Cited

U.S. PATENT DOCUMENTS

| | | | |
|---|---|---|---|
| 3,703,162 | 11/1972 | Aono | 123/32 EL |
| 3,794,003 | 2/1974 | Reddy | 123/97 B |
| 3,799,301 | 3/1974 | Bentley | 192/3 R |
| 3,809,028 | 5/1974 | Luchaco | 123/32 EL |
| 4,062,328 | 12/1977 | Konno | 123/32 EL |
| 4,064,844 | 12/1977 | Matsumoto et al. | 123/32 EL |
| 4,104,998 | 8/1978 | Fenn | 123/32 EA |

*Primary Examiner*—Parshotam S. Lall

*Attorney, Agent, or Firm*—Schwartz, Jeffery, Schwaab, Mack, Blumenthal & Koch

[57] ABSTRACT

An electronic controlled fuel injection system is disclosed for use in an internal combustion engine including a plurality of cylinders each fitted with a fuel injection valve. The system comprises a fuel injection control circuit timed to engine rotation for providing a drive pulse signal to the fuel injection valves. A deceleration detecting circuit detects deceleration of the engine in accordance with the positions of the associated throttle valve and foot brake. A coupling circuit is responsive to engine rotational speed for allowing or impeding the passage of the drive pulse signal to the fuel injection valves during deceleration.

28 Claims, 10 Drawing Figures

ELECTRONIC CONTROLLED FUEL INJECTION SYSTEM

BACKGROUND OF THE INVENTION

1. Field of the Invention

This invention relates to an electronic controlled fuel injection system for use in an internal combustion engine having a plurality of cylinders each fitted with a fuel injection valve. The invention is more particularly concerned with such a system adapted to cut off fuel to at least some of the cylinders during deceleration.

2. Description of the Prior Art

Electronic controlled fuel injection systems have already been proposed which are adapted to cut off the supply of fuel to the cylinders during deceleration in order to achieve high fuel economy. In U.S. application Ser. No. 34,285, there is described a fuel injection system adapted to resume the supply of fuel to the cylinders when the engine rotational speed falls below a reference level. The reference level is controlled to increase with an increase in engine cooling water temperature in order to assure stabilized running of the engine.

During initial deceleration, the throttle valve moves rapidly to its closed position thus causing a rapid increase in intake vacuum. The increased vacuum draws fuel sticking to the inner wall of the intake passage downstream of the throttle valve or fuel injection valve into the combustion chamber. This results in poor fuel combustion and thus a rapid increase of HC emissions from the engine. In order to prevent such poor fuel combustion from occurring during initial deceleration, a dashpot or throttle opener is provided so as to permit the throttle valve to close slowly and the intake vacuum to gradually increase.

For the purpose of cutting off fuel to the cylinders, the conventional fuel injection system includes a switch actuated when the throttle valve is fully closed for detecting deceleration of the engine. That is, the system starts cutting off fuel to the cylinders after the throttle valve arrives at its fully closed position. With a throttle valve associated with a dashpot or throttle opener to delay the arrival of the throttle valve at its fully closed position, the throttle valve will fully close a time after the initiation of deceleration of the engine. Thus, the engine rotational speed falls below the predetermined level prior to the throttle valve reaching its fully closed position so that fuel is continuously supplied to the cylinders if, for example, the automotive vehicle is brought to a stop with the use of the foot brake.

In addition, there is a general tendency to frequently use the foot brake where a throttle valve is associated with a dashpot or throttle opener since the engine braking force is not effective just after the engine has been shifted to its deceleration mode of operation. Accordingly, it is desirable to detect not only the closed position of the throttle valve but also the depression of the foot brake in order to obtain rapid deceleration detection.

SUMMARY OF THE INVENTION

It is therefore one object of the present invention to provide an electronic controlled fuel injection system which is high in fuel economy.

Another object of the present invention is to provide an electronic controlled fuel injection system of the character described which can cut off and resume the supply of fuel to the cylinders of an engine during deceleration with greater responsiveness to an initiation of deceleration of the engine.

Still another object of the present invention is to provide an electronic controlled fuel injection system of the character described which can cut off and resume the supply of fuel to some of the cylinders during deceleration with a greater responsiveness to an initiation of deceleration of the engine.

According to the present invention, these and other objects are accomplished by an electronic controlled fuel injection system for use in an automotive vehicle including a transmission, a foot brake, an internal combustion engine having a throttle valve, a plurality of cylinders each fitted with a fuel injection valve, the system comprising, in combination: a fuel injection control circuit timed to rotation of the engine for providing a drive pulse signal to the fuel injection valves so as to provide a predetermined inlet air-fuel ratio; a deceleration detecting circuit for providing a signal indicative of engine deceleration when the throttle valve is in its closed position or the foot brake is depressed while the transmission is in its neutral position; and a coupling circuit responsive to the signal from the deceleration detecting circuit for allowing or impeding the passage of the drive pulse signal from the fuel injection control circuit to the fuel injection valves in accordance with engine rotational speed.

For the purpose of higher fuel economy, a second coupling circuit may be provided which is responsive to the signal from the deceleration detecting circuit for allowing or impeding application of the drive pulse signal to some of the fuel injection valves in accordance with engine rotational speed.

Other objects, means, and advantages of the present invention will become apparent to one skilled in the art thereof from the following description.

DESCRIPTION OF THE PREFERRED EMBODIMENTS

Figure 1:
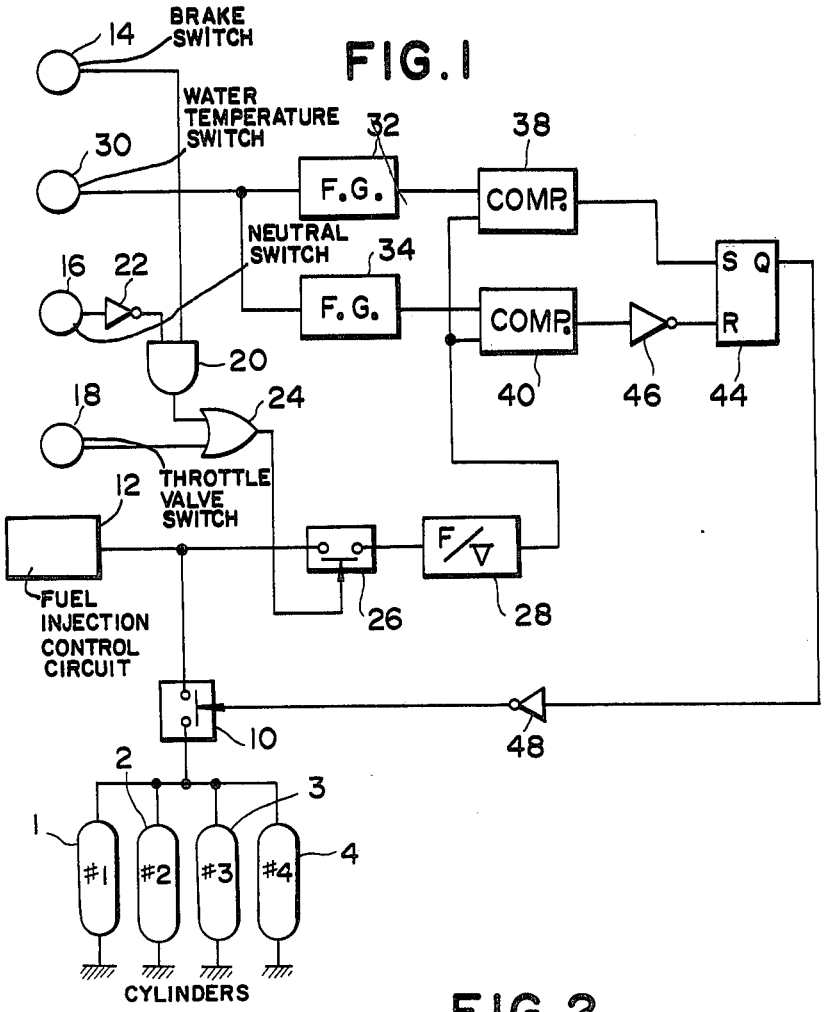
FIG. 1 is a block diagram showing a first embodiment of an electronic controlled fuel injection system made in accordance with the present invention.

Referring now to FIG. 1, there is illustrated one embodiment of an electronic controlled fuel injection system made in accordance with the present invention. The system is for use in an internal combustion engine including a plurality of cylinders (in the illustrated case four cylinders #1 to #4) each having an intake passage fitted with a fuel injection valve. The fuel injection valves 1 to 4 are connected through a normally open analog switch 10 to a fuel injection control circuit 12. The fuel injection control circuit 12 has inputs from various sensors (not shown). The sensors are adapted to sense various engine operating parameters such as engine rotational speed, intake air flow, etc. for providing, to the fuel injection valves 1 to 4, a drive pulse signal having its pulse width determined in accordance with such engine operating parameters. The drive pulse signal controls amount of fuel injected through the fuel injection valves 1 to 4 into the corresponding cylinders #1 to #4 so as to provide a predetermined inlet air-fuel ratio when the switch 10 is closed. When the switch 10 is open, the drive pulse signal to the fuel injection valves 1 to 4 is inhibited so that the supply of fuel to the cylinders #1 to #4 is cut off.

The system also comprises a deceleration detecting circuit which includes a brake switch 14 actuated when the foot brake (not shown) of the automotive vehicle is depressed, a neutral switch 16 actuated when the transmission (not shown) of the automotive vehicle is in its neutral position, and a throttle valve switch 18 actuated when the throttle valve of the engine is in its fully closed position. The brake switch 14 is connected to one input of an AND gate 20 which has the other input connected through an inverter 22 to the neutral switch 16. The output of the AND gate 20 is connected to one input of an OR gate 24 having the other input connected to the throttle valve switch 18. If the foot brake is depressed except when the transmission is in its neutral position or the throttle valve is in its fully closed position, the output of the OR gate 24 is high, which represents deceleration of the engine.

It is to be noted that the fuel injection control circuit 12 generates at its output a drive pulse signal in synchronism with rotation of the engine and thus the frequency of the drive pulse signal is indicative of engine rotational speed. The output of the fuel injection control circuit 12 is connected through a normally open analog switch 26 to a frequency-to-voltage converter 28 which converts the frequency of the drive pulse signal to a voltage indicative of the actual engine rotational speed. The switch 26 is closed when the output of the OR gate 24 is high.

Figure 2:
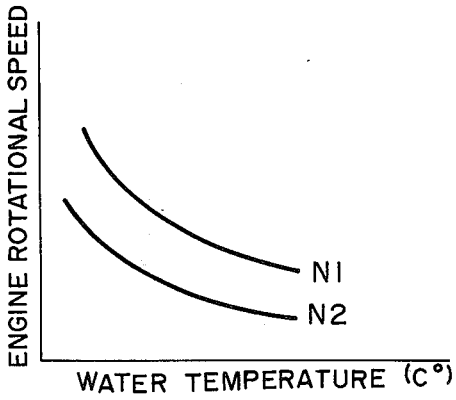
FIG. 2 is a graph showing the first and second reference engine rotational speed levels used in the system of FIG. 1.

An engine cooling water temperature sensor 30 is provided, the output of which is connected to first and second function generators 32 and 34. The first function generator 32 generates at its output a voltage indicative of a first reference engine rotational speed level N1. The second function generator 34 generates at its output a voltage indicative of a second reference engine rotational speed level N2 which is lower than the first reference level N1. As shown in FIG. 2, the first and second reference levels N1 and N2 decrease with increase in engine cooling water temperature.

The output of the first function generator 32 is connected to one input of a first comparator 38 which has the other input connected to the output of the frequency-to-voltage converter 28 for comparing the actual engine rotational speed with the first reference level N1. If the former is higher than the latter, the output of the first comparator 38 goes high. The output of the second function generator 34 is connected to one input of a second comparator 40 which has the other input connected to the output of the frequency-to-voltage converter 28 for comparing the actual engine rotational speed with the second reference level N2. If the former is higher than the latter, the output of the second comparator 40 goes high.

The output of the first comparator 38 is connected directly to the set input of a flip-flop 44 and the output of the second comparator 40 is connected through an inverter 46 to the reset input of the flip-flop 44. The flip-flop 44 assumes a first state having a high output on its Q output when a high input is received on the set input and assumes a second state having a low output on its Q output when a high input is received on the reset input. If low inputs are received on the set and reset inputs, the flip-flop 44 assumes the previous state.

Thus, if the engine rotational speed is above the first reference level N1 when deceleration of the engine is detected, the output of the flip-flop 44 is high. When the engine rotational speed falls below the first reference level N1 but above the second reference level N2, the output of the flip-flop 44 is held high. When the engine rotational speed further falls below the second reference level N2, the output of the flip-flop 44 goes low. During acceleration when the engine rotational speed increases, the switch 26 is held open to shut off the drive pulse signal to the frequency-to-voltage converter 28 and thus the output of the flip-flop 44 is held low. If the engine rotatonal speed is between the first and second reference levels N1 and N2 when deceleraton of the engine is detected, the output of the flip-flop 44 is held low since the flip-flop 44 receives low inputs on the set and reset inputs.

The output of the flip-flop 44 is connected through an inverter 48 to the switch 10. The switch 10 is closed to allow application of the drive pulse signal from the fuel injection control circuit 12 to the fuel injection valves 1 to 4 when the output of the flip-flop 44 is low and is open to shut off the drive pulse signal to the fuel injection valves 1 to 4 when it is high.

Figure 3:
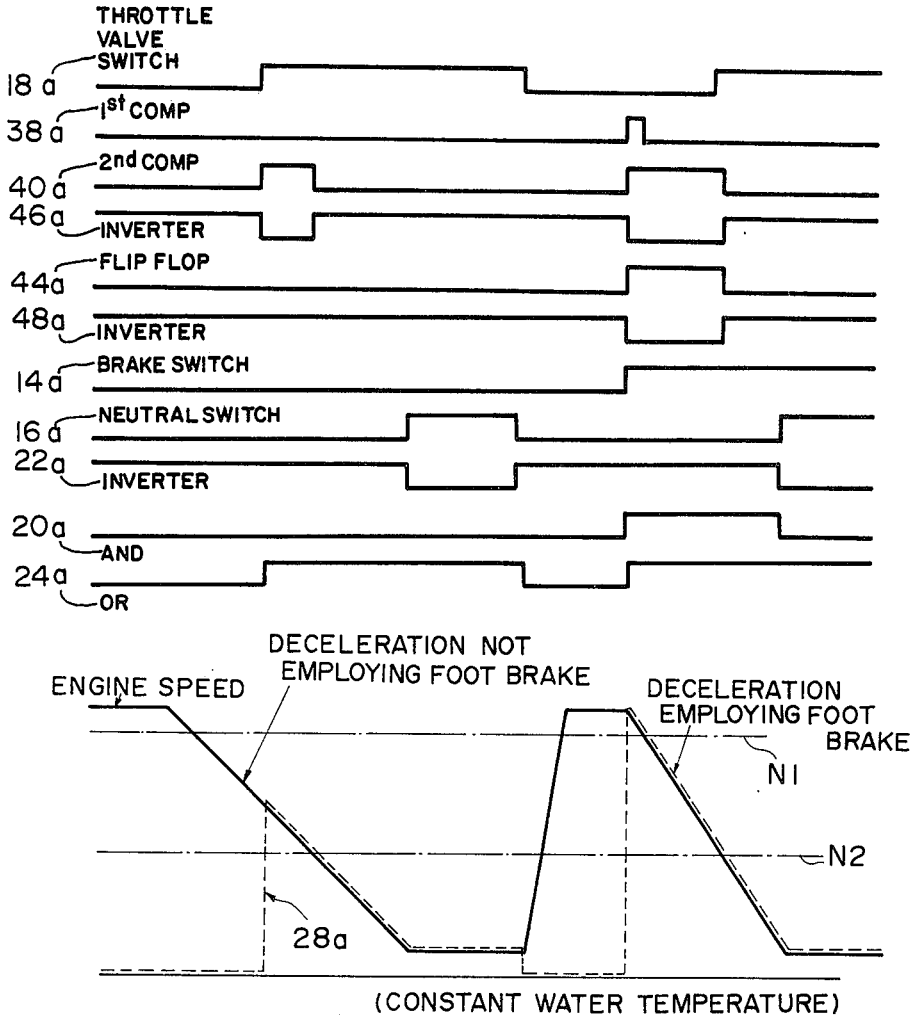
FIG. 3 is a time chart showing a plurality of wave forms representing the outputs of various elements in the system of FIG. 1.

The operation of the system of FIG. 1 will be described with reference to the wave forms of FIG. 3.

It is first assumed that the foot brake is not in use during deceleration and the engine rotational speed is between the first and second reference levels N1 and N2 when the throttle valve moves to its fully closed position to actuate the throttle valve switch 18 thereby closing the switch 26. Due to the provision of a dashpot or throttle opener, there may be a delay of two or three seconds after the initiation of deceleration of the engine until the throttle valve arrives at its fully closed position to actuate the throttle valve switch 18, as seen in wave form 18*a* of FIG. 3. When switch 26 is closed, the drive pulse signal is applied from the fuel injection control circuit 12 to the frequency-to-voltage converter 28 which converts its frequency to a voltage indicative of the actual engine rotational speed. The actual engine rotational speed is compared with the first reference level N1 in the first comparator 38 and with the second reference level N2 in the second comparator 40. Since the rotational engine speed is between the first and second reference levels N1 and N2, the output of the first comparator 38 is low as seen in wave form 38*a* of FIG. 3 and the output of the second comparator 40 is high as seen in wave form 40*a* of FIG. 3. Thus, the flip-flop 44 receives low inputs on its set and reset inputs and its output is held low as seen in wave form 44*a* of FIG. 3. This holds the switch 10 closed to allow application of the drive pulse signal from the fuel injection control circuit 12 to the fuel injection valves 1 to 4 so that fuel is injected therethrough into the respective cylinders #1 to #4. When the engine rotational speed falls below the second reference level N2, the output of the second comparator 40 goes low as seen in wave form 40*a* of FIG. 3. Thus, the flip-flop 44 receives a low input on its set input and a high input on its reset input so that its output is held low as seen in wave form 44*a* of FIG. 3. As a result, the switch 10 is held closed so that fuel is injected through the fuel injection valves 1 to 4 into the respective cylinders #1 to #4.

When the engine rotational speed increases again, switch 26 is opened to inhibit application of the drive pulse signal from fuel injection control circuit 12 to frequency-to-voltage converter 28. Thus, the output of the flip-flop 44 is held low as seen in wave form 44*a* of FIG. 3 and fuel is injected through the fuel injection valves 1 to 4 into the respective cylinders #1 to #4.

Next, it will be assumed that the foot brake is depressed to decelerate the engine when the engine rotational speed is above the first reference level N1. Simultaneously with the initation of deceleration of the engine, the brake switch 14 is actuated as seen in wave form 14*a* of FIG. 3 to close the switch 26 so as to allow application of the drive pulse signal from the fuel injection control circuit 12 to the frequency-to-voltage converter 28. In this case, the outputs of the first and second comparators 38 and 40 go high as seen in wave forms 38*a* and 40*a* of FIG. 3 and the flip-flop 44 receives a high input on its set input and a low input on its reset input. Thus, the output of the flip-flop 44 goes high as seen in wave form 44*a* of FIG. 3 and the output of the inverter 48 goes low as seen in wave form 48*a* of FIG. 3 to open the switch 10. As a result, the drive pulse signal from fuel injection control circuit 12 to fuel injection valves 1 to 4 is shut off and fuel to the cylinders #1 to #4 is cut off.

When the engine rotational speed falls below the first reference level N1 but above the second reference level N2, the output of the first comparator 38 goes low as seen in wave form 38*a* of FIG. 3 and the output of the second comparator 40 is held high as seen in wave form 40*a* of FIG. 3. Thus, the flip-flop 44 receives low inputs on its set and reset inputs so that its output is held high as seen in wave form 44*a* of FIG. 3. As a result, switch 10 is held open to shut off the drive pulse signal to the fuel injection valves 1 to 4 so as to cut off fuel to the cylinders #1 to #4.

When the engine rotational speed further falls below the second reference level N2, the output of the first comparator 38 is held low as seen in wave form 38*a* of FIG. 3 and the output of the second comparator 40 goes low as seen in wave form 40*a* of FIG. 3. Thus, the flip-flop 44 receives a low input on its set input and a high input on its reset input so that its output goes low as seen in wave form 44*a* of FIG. 3. As a result, switch 10 is closed to allow application of the drive pulse signal from the fuel injection control circuit 12 to the fuel injection valves 1 to 4 so as to resume the supply of fuel to the respective cylinders #1 to #4.

In this embodiment, deceleration of the engine is detected in accordance with a signal from a brake switch actuated by depression of the foot brake or a throttle valve switch actuated when the throttle valve is fully closed. If the foot brake is depressed to decelerate the engine, the brake switch is actuated simultaneously with the depression of the foot brake so as to allow the engine to be placed in its fuel cut-off condition from the initiation of engine deceleration. This is advantageous to achieve high fuel economy. If the automotive vehicle runs on a gradual downward slope, engine braking force is mainly used and the foot brake is seldom used. In such a case, fuel cut-off is accomplished a time after the initiation of deceleration of the engine, the time being determined by the dashpot or throttle opener.

Figure 4:
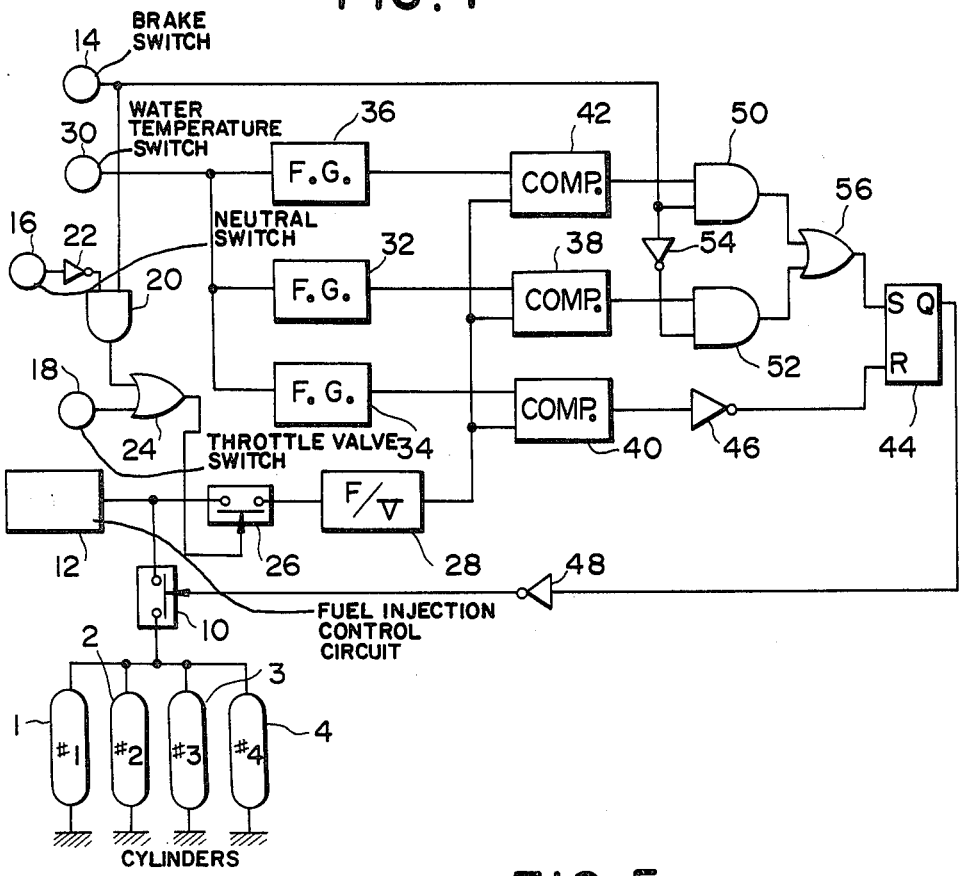
FIG. 4 is a block diagram showing a second embodiment of the present invention.
Figure 5:
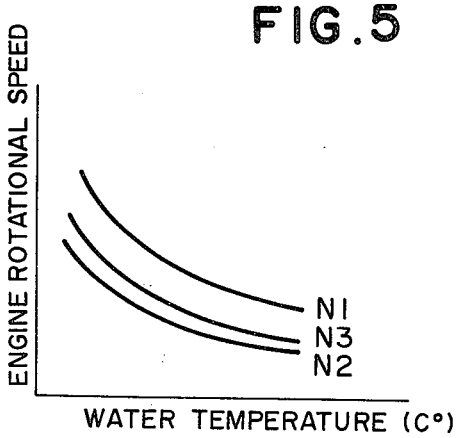
FIG. 5 is a graph showing the first, second and third reference engine rotational speed levels used in the system of FIG. 4.

Referring to FIG. 4, there is illustrated a second emobodiment of the present invention where like reference numerals indicate like parts as described with reference to FIG. 1. In this embodiment, the output of the engine cooling water temperature sensor 30 is additionally connected to the input of a third function generator 36 which generates at its output a voltage indicative of a third reference engine rotational speed level N3 decreasing with increase in engine cooling water temperature. As shown in FIG. 5, the third reference level N3 is lower than the first reference level N1 and higher than the second reference level N2.

The output of the third function generator 36 is connected to one input of a third comparator 42 which has the other input connected to the output of the frequency-to-voltage converter 28 for comparing the actual engine rotational speed with the third reference level N3. If the former is higher than the latter, the output of the third comparator 42 goes high. The output of the third comparator 42 is connected to one input of an AND gate 50 which has the other input connected to the brake switch 14 for passing the output of the third comparator 42 when the brake switch 14 is actuated. The output of the first comparator 38 is connected to an AND gate 52 which has the other input connected through an inverter 54 to the brake switch 14 for passing the output of the first comparator 38 when the brake switch 14 is not actuated.

An OR gate 56 is provided which has one input connected to the output of the AND gate 50 and the other input connected to the output of the AND gate 52. The output of the OR gate 56 is connected to the set input of the flip-flop 44. Otherwise the structure of the system is the same as described in relation to FIG. 1.

Figure 6:
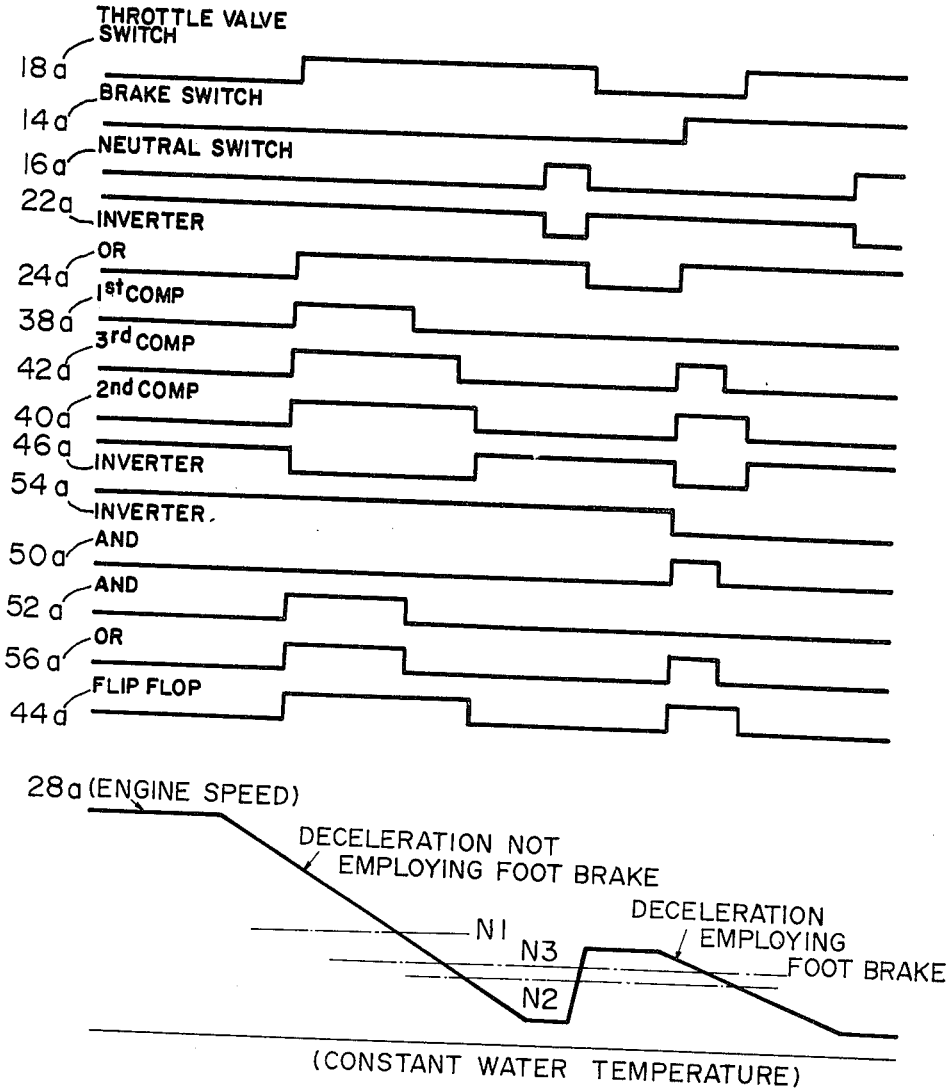
FIG. 6 is a time chart showing a plurality of wave forms representing the outputs of various elements in the system of FIG. 4.

The operation of the system of FIG. 4 will be described with reference to the wave forms of FIG. 6.

It is first assumed that foot brake is out of operation during deceleration. The throttle valve moves to its fully closed position to actuate the throttle valve switch 18 thereby closing the switch 26 two or three seconds after the intitiation of deceleration of the engine as seen in wave form 18i a of FIG. 6. If the engine rotational speed is above the first reference level N1 when the switch 26 is closed, the outputs of the first, second and third comparators 38, 40, and 42 go high as seen in wave forms 38*a*, 40*a* and 42*a* of FIG. 6. Since the brake switch 14 is not actuated in this case, the output of the AND gate 50 is low as seen in wave form 50*a* of FIG. 6 and the output of the AND gate 52 is high as seen in wave form 52*a* of FIG. 6. Thus, the output of the OR gate 56 is high as seen in wave form 56*a* of FIG. 6 and the flip-flop 44 receives a high input on its set input and a low input on its reset input. This causes the flip-flop 44 to generate on its Q output a high output as seen in wave form 44*a* of FIG. 6. The high output of the flip-flop 44 is coupled to the input of the inverter 48 to render its output low so as to open the switch 10. As a result, the drive pulse signal from the fuel injection control circuit 12 to the fuel injection valves 1 to 4 is inhibited and fuel to the cylinders #1 to #4 is cut off.

When the engine rotational speed falls below the first reference level N1 but above the third reference level N3, the output of the first comparator 38 goes low as seen in wave form 38*a* of FIG. 6 to render the output of the AND gate 52 low as seen in wave form 52*a* of FIG. 6 and the outputs of the second and third comparators 40 and 42 are held high as seen in wave forms 40*a* and 42*a* of FIG. 6. Thus, the flip-flop 44 receives low inputs on its set and reset inputs so that its output is held high as seen in wave form 44*a* of FIG. 6. As a result, the switch 10 is held open to shut off the drive pulse signal to the fuel injection valves 1 to 4 so as to cut off fuel to the cylinders #1 to #4.

When the engine rotational speed falls below the third reference level N3 but above the second reference level N2, the output of the first comparator 38 is held low as seen in wave form 38*a* of FIG. 6, the output of the second comparator 40 is held high as seen in wave form 40*a* of FIG. 6, and the output of the third comparator 42 goes low as seen in wave form 42*a* of FIG. 6, which does not change the state of the flip-flop 44. Thus, fuel to the cylinders #1 to #4 is cut off.

When the engine rotational speed falls below the second reference level N2, the outputs of the first and third comparators 38 and 42 are held low as seen in wave forms 38*a* and 42*a* of FIG. 6 and the output of the second comparator 40 goes low as seen in wave form 40*a* of FIG. 6 to render the output of the inverter 46 high as seen in wave form 46*a* of FIG. 6. Thus, the flip-flop 44 receives a low input on its set input and a high input on its reset input so that its output goes low as seen in wave form 44*a* of FIG. 6. This causes the inverter 48 to provide a high output to the switch 10 which is closed thereby. As a result, the drive pulse signal is applied from the fuel injection control circuit 12 to the fuel injection valves 1 to 4 so as to resume the supply of fuel to the respective cylinders #1 to #4.

Assuming then that the foot brake is used to decelerate the engine, the brake switch 14 is actuated to close the switch 26 simultaneously with the initiation of deceleration of the engine. If the engine rotational speed is below the first reference level N1 but above the third reference level N3 when the switch 26 is closed, the output of the first comparator 38 is held low as seen in wave form 38*a* of FIG. 6 and the outputs of the second and third comparators 40 and 42 go high as seen in wave forms 40*a* and 42*a* of FIG. 6. Since the brake switch 14 is actuated in this case, the output of the AND gate 50 goes high as seen in wave form 50*a* of FIG. 6 and the output of the AND gate 52 is held low as seen in wave form 52*a* of FIG. 6. Thus, the output of the OR gate 56 goes high as seen in wave form 56*a* of FIG. 6 and the flip-flop 44 receives a high input on its set input and a low input on its reset input. This causes the flip-flop 44 to generate on its output a high output as seen in wave form 44*a* of FIG. 6 to render the output of the inverter 48 low so as to open the switch 10. As a result, the drive pulse signal from the fuel injection control circuit 12 to the fuel injection valves 1 to 4 is shut off and fuel to the cylinders #1 to #4 is cut off.

When the engine rotational speed falls below the third reference level N3 but above the second reference level N2, the output of the first comparator 38 is held low as seen in wave form 38*a* of FIG. 6, the output of the second comparator 40 is held high as seen in wave form 40*a* of FIG. 6 and the output of the third comparator 42 goes low as seen in wave form 42*a* of FIG. 6. Thus, the flip-flop 44 receives low inputs on its set and reset inputs so that its output is held high as seen in wave form 44*a* of FIG. 6. As a result, the switch 10 is held open to shut off the drive pulse signal to the fuel injection valves 1 to 4 so that fuel to the cylinders #1 to #4 is cut off.

When the engine operational speed falls below the second reference level N2, the outputs of the first and third comparators 38 and 42 are held low as seen in wave forms 38*a* and 42*a* of FIG. 6 and the output of the second comparator 40 goes low as seen in wave form 40*a* of FIG. 6. Thus, the flip-flop 44 receives a low input on its set input and a high input on its reset input so that its output goes low as seen in wave form 44*a* of FIG. 6. This causes the inverter 48 to provide a high output to the switch 10 to close it. As a result, the drive pulse signal is applied from the fuel injection control circuit 12 to the fuel injection valves 1 to 4 so as to resume the supply of fuel to the respective cylinders #1 to #4.

It can be seen from the foregoing that this embodiment permits suspension of the fuel supply to the cylinders while the engine rotational speed falls from the third reference level N3 to the second reference level N2 even if the engine rotational speed is below the first reference level N1 when deceleration is detected. This achieves better fuel economy.

Figures 7, 8:
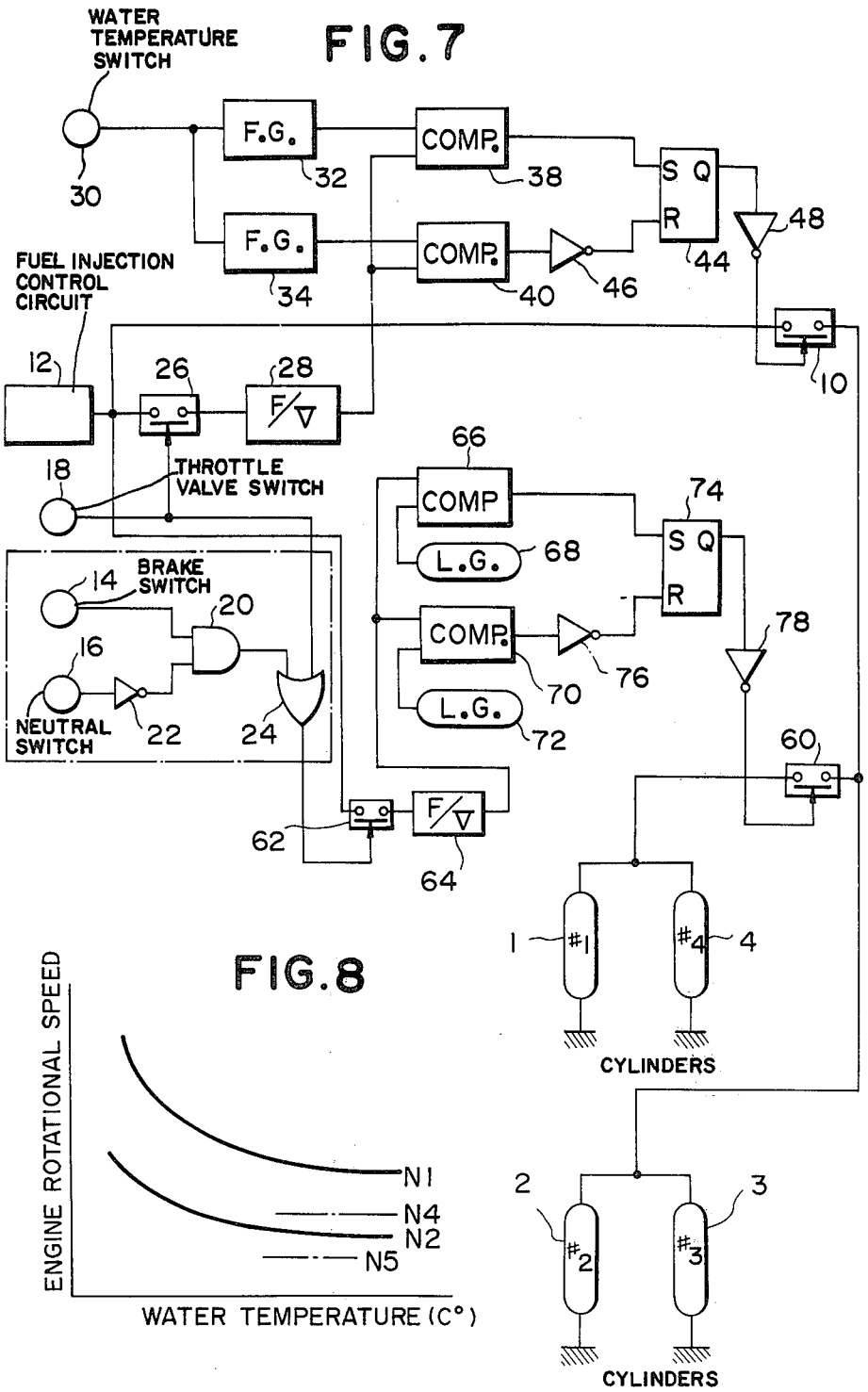
FIG. 7 is a block diagram showing a third embodiment of the present invention.
FIG. 8 is a graph showing the first, second, fourth and fifth reference engine rotational speed levels used in the system of FIG. 7.

Referring to FIG. 7, there is illustrated a third embodiment of the present invention where like reference numerals indicate like parts as described with reference to FIG. 1. In this embodiment, the cylinders are split into first and second groups. The fuel injection valves 1 and 4 fitted in the first group of cylinders #1 and #4 are connected through a normally open analog switch 60 to one terminal of the switch 10. The fuel injection valves 2 and 3 fitted in the second group of cylinders #2 and #3 are connected directly to the one terminal of the switch 10. The other terminal of the switch 10 is connected to the fuel injection control circuit 12 as described in relation to FIG. 1.

A normally open analog switch 62 is provided which is closed when the output of the OR gate 24 is high. The switch 62 has a terminal connected to the fuel injection control circuit 12 and the other terminal connected to a frequency-to-voltage converter 64 which converts the frequency of the drive pulse signal from the fuel injection control circuit 12 to a voltage indicative of engine rotational speed. The output of the frequency-to-voltage converter 64 is connected to one input of a fourth comparator 66 which has the other input connected to a first level signal generator 68. The first level signal generator 68 generates at its output a constant voltage indicative of a fourth reference engine rotational speed level N4 which is lower than the first reference level N1 and higher than the second reference level N2 as shown in FIG. 8. Thus, the fourth comparator 66 compares the actual engine rotational speed with the fourth reference level N4 to provide a high output when the former is higher than the latter.

The output of the frequency-to-voltage converter 64 is also connected to one input of a fifth comparator 70 which has the other input connected to a second level signal generator 72. The second level signal generator 72 generates at its output a constant voltage indicative of a fifth reference engine rotational speed level N5 which is lower than the second reference level N2 as shown in FIG. 8. Thus, the fifth comparator 70 compares the actual engine rotational speed with the fifth reference level N5 to provide a high output when the former is higher than the latter.

The output of the fourth comparator 66 is connected directly to the set input of a flip-flop 74 and the output of the fifth comparator 70 is connected through an inverter 76 to the reset input of the flip-flop 74. The operation of the flip-flop 74 is the same as that of the flip-flop 44 as described in relation to FIG. 1. The Q output of the flip-flop 74 is connected through an inverter 78 to the switch 60. The switch 60 is closed when the output of the flip-flop 74 is low. The switch 26 is closed only when the throttle valve is fully closed to actuate the throttle valve switch 18. Otherwise the structure of the system is the same as described in relation to FIG. 1.

Figure 9:
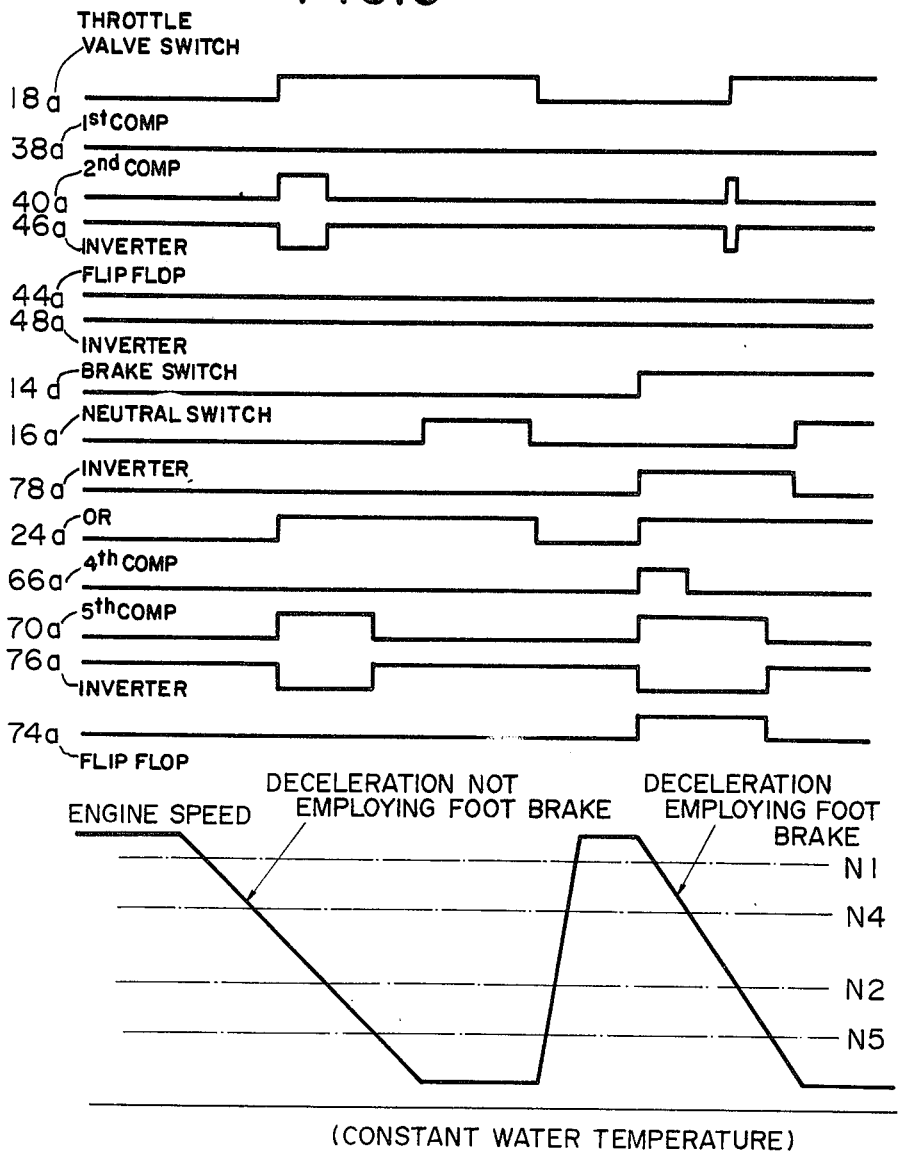
FIG. 9 is a time chart showing a plurality of wave forms representing the outputs of various elements in the system of FIG. 7.

The operation of the system of FIG. 7 will be described with reference to the wave forms of FIG. 9.

It is first assumed that the foot brake is out of operation during deceleration. The throttle valve moves to its fully closed position to actuate the throttle valve switch 18 thereby closing the switches 26 and 62 two or three seconds after the initiation of deceleration of the engine as seen in wave form 18*a* of FIG. 9. If the engine rotational speed is below the fourth reference level N4 but above the second reference level N2 when the switch 26 is closed, the output of the flip-flop 44 is held low to hold the switch 10 closed as described in relation to FIG. 3.

When the switch 62 is closed, the drive pulse signal is also applied to the frequency-to-voltage converter 64 which converts its frequency to a voltage indicative of the actual engine rotational speed. The actual engine rotational speed is compared with the fourth reference level N4 in the fourth comparator 66 and with the fifth reference level N5 in the fifth comparator 70. Since the rotational engine speed is between the fourth and fifth reference levels N4 and N5, the output of the fourth comparator 66 is low as seen in wave form 66*a* of FIG. 9 and the output of the fifth comparator 70 is high as seen in wave form 70*a* of FIG. 9. Thus, the flip-flop 74 receives low inputs on its set and reset inputs and its output is held low as seen in wave form 74*a* of FIG. 9. This holds the switch 60 closed to allow application of the drive pulse signal from the fuel injection control circuit 18 to all of the fuel injection valves 1 to 4 so that fuel is injected into the first and second groups of cylinders #1 to #4.

When the engine rotational speed falls below the second reference level N2 but above the fifth reference level N5, the switch 10 is held closed as described in relation to FIG. 3 and the switch 60 is held closed. As a result, the drive pulse signal is continuously applied to all of the fuel injection valves 1 to 4 to inject fuel into the first and second groups of cylinders #1 to #4.

When the engine rotational speed falls below the fifth reference level N5, the output of the fifth comparator 70 goes low as seen in wave form 70*a* of FIG. 9. Thus, the flip-flop 74 receives a low input on its set input and a high input on its reset input so that its output is held low as seen in wave form 74*a* of FIG. 9. As a result, the switch 60 is held closed so that the drive pulse signal is continuously applied to all of the fuel injection valves 1 to 4 to inject fuel into the first and second groups of cylinders #1 to #4.

Assuming then that the foot brake is depressed to decelerate the engine, the switch 62 is closed simultaneously with the initiation of deceleration of the engine, but the switch 26 is closed two or three seconds after the initiation of deceleration of the engine. It is further assumed that the engine rotational speed is below the fourth reference level N4 but above the second reference level N2.

When the engine rotational speed is above the first reference level N1, the output of the flip-flop 44 is held low and the switch 10 is closed since the switch 26 is still open. At this time, the outputs of the fourth and fifth comparators 66 and 70 go high as seen in wave forms 66*a* and 70*a* of FIG. 9 and the flip-flop 74 receives a high input on its set input and a low input on its reset input so that its output goes high as seen in wave form 74*a* of FIG. 9. This renders the output of the inverter 78 low to open the switch 60. As a result, the drive pulse signal is applied only to the fuel injection valves 2 and 3 to inject fuel into the second group of cylinders #2 and #3.

When the engine rotational speed falls below the first reference level N1 but above the fourth reference level N4, the flip-flop 44 provides a low output to hold the switch 10 closed since the switch 26 is still open and the switch 60 is held open. As a result, the drive pulse signal is applied only to the fuel injection valves 2 and 3.

When the engine rotational speed falls below the fourth reference level N4, the output of the first comparator 66 goes low as seen in wave form 66*a* of FIG. 9 and the output of the second comparator 70 is held high as seen in wave form 70*a* of FIG. 9. Thus, the flip-flop 74 receives low inputs on its set and reset inputs so that its output is held high as seen in wave form 74*a* of FIG. 9. As a result, the switch 60 is held open and the drive pulse signal is applied only to the fuel injection valves 2 and 3 since the flip-flop 44 provides a low output to hold the switch 10 closed even if the throttle valve switch 18 is actuated at this time.

When the engine rotational speed falls below the second reference level N2 but above the fifth reference level N5, the flip-flop 44 provides a low output to hold the switch 10 closed as described in relation to FIG. 3 and the switch 60 is held open. As a result, the drive pulse signal is applied only to the fuel injection valves 2 and 3.

When the engine rotational speed falls below the fifth reference level N5, the flip-flop 44 provides a low output to hold the switch 10 closed as described in relation to FIG. 3. At this time, the output of the fourth comparator 66 is held low as seen in wave form 66*a* of FIG. 9 and the output of the fifth comparator 70 goes low as seen in wave form 70*a* of FIG. 9. Thus, the flip-flop 74 receives a low input on its set input and a high input on its reset input so that its output goes low as seen in wave form 44*a* of FIG. 9. As a result, the switch 60 is closed to allow application of the drive pulse signal from the fuel injection control circuit 12 to all of the fuel injection valves 1 to 4 to inject fuel into the first and second groups of cylinders #1 to #4.

Although the switch 26 has been described as closed only when the throttle valve switch 18 is actuated, it is to be noted that the switch 26 may be operated in accordance with the output of the OR gate 24 as described in connection with the first embodiment of FIG. 1.

If the second reference level N2 is set too low in the first and second embodiments where fuel is cut off from all of the cylinders, engine stalling would occur. In this embodiment, fuel is cut off from some of the cylinders until the engine rotational speed falls below the fifth reference level N5 but above the second reference level N2. This achieves higher fuel economy.

Figure 10:
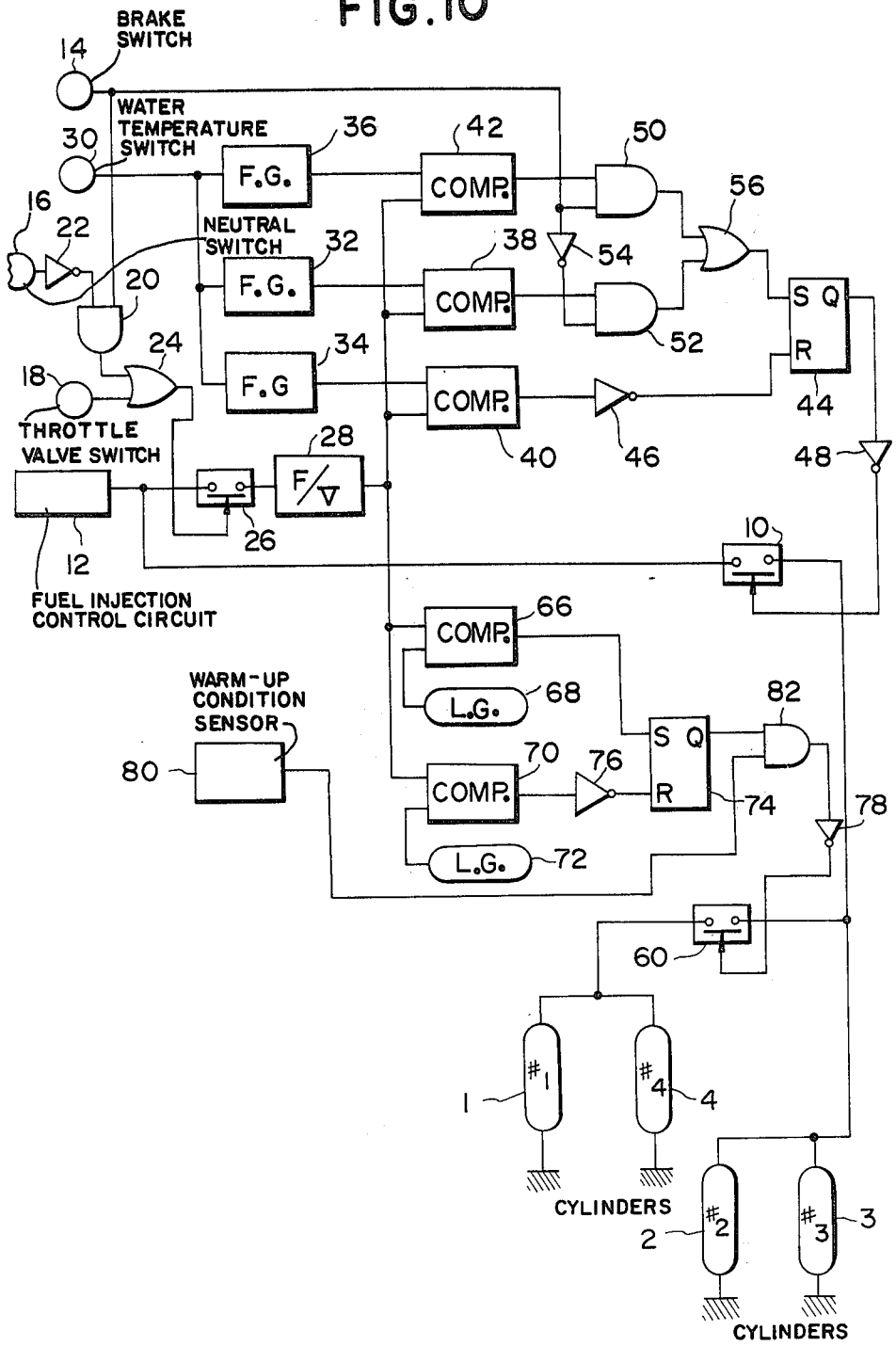
FIG. 10 is a block diagram showing a fourth embodiment of the present invention.

Referring to FIG. 10, there is illustrated a fourth embodiment of the present invention. This embodiment is the combination of the second embodiment of FIG. 4 and the third embodiment of FIG. 7. Thus, the structure and operation of the system of FIG. 10 will be apparent from the description made in connection with the second and third embodiments. This embodiment achieves much higher fuel economy.

An engine warm-up condition sensor 80 may be provided, the output of which is connected to one input of an AND gate 82 which has the other input connected to the Q output of the flip-flop 74 and its output connected to the inverter 78 for preventing the switch 60 from closing before the engine warms up.

What is claimed is:

1. An electronic controlled fuel injection system for use in automotive vehicle including a transmission, a foot brake, an internal combustion engine having a throttle valve, a plurality of fuel injection valves, said system comprising, in combination:

(a) a fuel injection control circuit timed to rotation of said engine for providing a drive pulse signal having a frequency corresponding the speed of rotation of said engine to said fuel injection valves so as to provide a predetermined inlet air/fuel ratio;

(b) a first sensor for providing a signal when said throttle valve is in its closed position;

(c) a second sensor for providing a signal when said foot brake is depressed except when said transmission is in its neutral position;

(d) a deceleration signal generator for generating a deceleration signal when at least one of the signals occurs from said first and second sensors;

(e) a fuel-cut signal generator responsive to the control signal from said deceleration signal generator for providing a fuel-cut signal when the engine speed is above a first predetermined value and for terminating said fuel-cut signal when the engine speed is below a second predetermined valve lower than said first predetermined valve and comprising a frequency-to-voltage converter, first normally open switch means responsive to the signal from said deceleration signal generator for connecting the output of said fuel injection control circuit to the input of said frequency-to-voltage converter, a first signal generator generating on its output a signal indicative of a first reference engine rotational speed level, a second signal generator generating on its output a signal indicative of a second reference engine rotational speed level lower than said first reference level, a first comparator having its one input connected to the output of said frequency-to-voltage converter and the other input connected to the output of said first signal generator for providing a high output when the former is higher than the latter, a second comparator having its one input connected to the output of said frequency-to-voltage converter and the other input connected to the output of said second signal generator for providing a high output when the former is higher than the latter, a first inverter having its input connected to the output of said second comparator, a flip-flop having a set input connected to the output of said first comparator, a reset input connected to the output of said inverter, and an output, a second inverter having its input connected to said output of said flip-flop; and (f) a fuel-cut switch means responsive to said fuel-cut signal for disconnecting said fuel injection control circuit from said fuel injection valves and including a second normally open switch means having its one terminal connected to said fuel injection control circuit and the other terminal connected to the fuel injection valves, and said second switch means responsive to a high input from said inverter for allowing the passage of the drive pulse signal to said fuel injection valves.

2. An electronic controlled fuel injection system according to claim 1, wherein each of said first and second signal generators is taken in the form of a function generator associated with an engine cooling water temperature sensor for providing at its output a signal indicative of a reference engine rotational speed level decreasing with increase in engine temperature.

3. An electronic controlled fuel injection system according to claim 1, wherein said fuel injection valves are split into first and second groups and which further comprises a second fuel-cut signal generator responsive to the signal from said deceleration signal generator for providing a fuel-cut signal when the engine speed is above a third predetermined value and for terminating said fuel-cut signal when the engine speed is below a fourth predetermined value lower than said third predetermined value; and second fuel-cut switch means responsive to said fuel-cut signal from said second fuel-cut signal generator for disconnecting said fuel injection control circuit from said first group of fuel injection valves.

4. An electronic controlled fuel injection system according to claim 3, wherein said fuel-cut signal generator comprises a second frequency-to-voltage converter, third normally open switch means responsive to the signal from said deceleration signal generator for connecting the output of said fuel injection control circuit to the input of said second frequency-to-voltage converter, a third signal generator generating on its output a signal indicative of a third reference engine rotational speed level, a fourth signal generator generating on its output a signal indicative of a fourth reference engine rotational speed level lower than said third reference level, a third comparator having its one input connected to the output of said second frequency-to-voltage converter and the other input connected to the output of said third signal generator for providing a high output when the former is higher than the latter, a fourth comparator having its one input connected to the output of said second frequency-to-voltage converter and the other input connected to the output of said fourth signal generator for providing a high output when the former is higher than the latter, a third inverter having its input connected to the output of said fourth comparator, a second flip-flop having a set input connected to the output of said third comparator, a reset input connected to the output of said third inverter, and an output, a fourth inverter having its input connected to said output of said flip-flop; and said second fuel-cut switch means including a fourth normally open switch means having its one terminal connected to said other terminal of said second switch means and the other terminal connected to said first group of fuel injection valves, said fourth switch means responsive to a high input from said fourth inverter for allowing the passage of the drive pulse signal to said first group of fuel injection valves, and said other terminal of said second switch means directly connected to said second group of fuel injection valves.

5. An electronic controlled fuel injection system according to claim 4, wherein each of said third and fourth signal generators is adapted to provide a constant reference level.

6. An electronic controlled fuel injection system for use in an automotive vehicle including a transmission, a foot brake, an internal combustion engine having a throttle valve, a plurality of fuel injection valves, said system comprising, in combination:

(a) a fuel injection control circuit timed to the rotation of said engine for providing a drive pulse signal having a frequency corresponding to the speed of rotation of said engine to said fuel injection valves for providing a predetermined inlet air/fuel ratio;

(b) a first sensor for providing a signal when said throttle valve is in its closed position;

(c) a second sensor for providing a signal when said foot brake is depressed except when said transmission is in its neutral position;

(d) a deceleration signal generator for generating a deceleration signal when at least one of the signals occurs from said first and second sensors;

(e) a fuel-cut signal generator responsive to the signal from said deceleration signal generator for providing a fuel-cut signal when the engine speed is above a first predetermined value but above a third predetermined value lower than said first predetermined engine speed value during the application of braking and for terminating said fuel-cut signal when the engine speed is below a second predetermined value lower than said third predetermined engine speed value; and comprising a frequency-to-voltage converter, first normally open switch means responsive to the signal from said deceleration signal generator for connecting the output of said fuel injection control circuit to the input of said frequency-to-voltage converter, a first signal generator generating on its output a signal indicative of a first reference rotational speed level, a second signal generator generating on its output a signal indicative of a second reference engine rotational speed level lower than said first reference level, a third signal generator generating on its output a signal indicative of a third reference engine rotational speed level lower than said first reference level but higher than said second reference level, a first comparator having its one input connected to the output of said frequency-to-voltage converter and the other input connected to the output of said first signal generator for providing a high output when the former is higher than the latter, a second comparator having its one input connected to the output of said frequency-to-voltage converter and the other input connected to the output of said second signal generator for providing a high output when the former is higher than the latter, a third comparator having its one input connected to the output of said frequency-to-voltage converter and the other input connected to the output of said third signal generator for providing a high output when the former is higher than the latter, a first AND gate having its one input connected to the output of said third comparator and the other input connected to said second sensor for passing the output of said third comparator when said foot brake is depressed, a second AND gate having its one input connected to the output of said first comparator and the other input connected to the output of a first inverter having its input connected to the output of said second sensor for passing the output of said first comparator when said foot brake is not depressed, and OR gate having inputs from the first and second AND gates, a second inverter having its input connected to the output of said second comparator, a flip-flop having a set input connected to the output of said OR gate, a reset input connected to the output of said second inverter, and an output, a third inverter having its input connected to said output of said flip-flop; and a fuel-cut switch means responsive to said fuel-cut signal for disconnecting said fuel injection control circuit from said fuel injection valves and including a second normally open switch means having its one terminal connected to said fuel injection control circuit and the other terminal connected to the fuel injection valves, and said second switch means responsive to a high input from said inverter for allowing the passage of the drive pulse signal to said fuel injection valves.

7. An electronic controlled fuel injection system according to claim 6, wherein each of said first, second and third signal generators is taken in the form of a function generator associated with an engine cooling water temperature sensor for providing at its output a signal indicative of a reference engine rotational speed level decreasing with increase in engine temperature.

8. An electronic controlled fuel injection system according to claim 6, wherein said fuel injection valves are split into first and second groups and which further comprises a second fuel-cut signal generator responsive to the signal from said deceleration signal generator for providing a fuel-cut signal when the engine speed is above a fourth predetermined valve and for terminating said fuel-cut signal when the engine speed is below a fifth predetermined valve lower than said fourth predetermined valve and a second fuel-cut switch means responsive to said fuel-cut signal from said second fuel-cut signal generator for disconnecting said fuel injection control circuit form said first group of fuel injection valves.

9. An electronic controlled fuel injection system according to claim 8, wherein said second fuel-cut signal generator comprises a second frequency-to-voltage converter, third normally open switch means responsive to the signal from said deceleration signal generator for connecting the output of said fuel injection control circuit to the input of said second frequency-to-voltage converter, a fourth signal generator generating on its output a signal indicative of a fourth reference engine rotational speed level, a fifth signal generator generating on its output a signal indicative of a fifth reference engine rotational speed level lower than said fourth reference level, a fourth comparator having its one input connected to the output of said second frequency-to-voltage converter and the other input connected to the output of said fourth signal generator for providing a high output when the former is higher than the latter, a fifth comparator having its one input connected to the output of said second frequency-to-voltage converter and the other input connected to the output of said fifth signal generator for providing a high output when the former is higher than the latter, a fourth inverter having its input connected to the output of said fifth comparator, a second flip-flop having a set input connected to the output of said fourth comparator, a reset input connected to the output of said third inverter, and an output, a fifth inverter having its input connected to said output of said flip-flop, and said second fuel-cut switch means including a fourth normally open switch means having its one terminal connected to said other terminal of said second switch means and the other terminal connected to said first group of fuel injection valves, said fourth switch means responsive to a high input from said fifth inverter for allowing the passage of the drive pulse signal to said first group of fuel injection valves, and said other terminal of said second switch means directly connected to said second group of fuel injection valves.

10. An electronic controlled fuel injection system according to claim 9, wherein each of said fourth and fifth signal generators is adapted to provide a constant reference level.

11. An electronic controlled fuel injection system according to claim 9, which further comprises an engine warm-up condition sensor, a fourth AND gate having its one input connected to said output of said second flip-flop, the other input connected to said engine warm-up sensor, and its output connected to the input of said fourth inverter for preventing said fourth switch from closing before the engine warms up.

12. An electronic controlled fuel injection system for use in an automotive vehicle including a transmission, a foot brake, an internal combustion engine having a throttle valve, and a plurality of fuel injection valves, said system comprising, in combination:

(a) a fuel injection control circuit timed to rotation of said engine for providing a drive pulse signal having a frequency corresponding to the speed of rotation of said engine to said fuel injection valves so as to provide a predetermined inlet air/fuel ratio;

(b) a first sensor for providing a signal when said throttle valve is in its closed position;

(c) a second sensor for providing a signal when said foot brake is depressed except when said transmission is in its neutral position;

(d) a deceleration signal generator for generating a deceleration signal when at least one of the signals occurs from said first and second sensors;

(e) a fuel-cut signal generator responsive to the deceleration signal from said deceleration signal generator for providing a fuel-cut signal when the engine speed is above a first predetermined value and for terminating said fuel-cut signal when the engine speed is below a second predetermined value lower than said first predetermined value; and (f) switch means responsive to said fuel-cut signal for controlling application of said drive pulse signal of said fuel injection control circuit to said fuel injection valves.

13. An electronic controlled fuel injection system according to claim 12, wherein said fuel-cut signal generator includes:

first signal generating means for generating a first signal when the engine speed is above said first determined value;

second signal generating means for generating a second signal indicative of an engine speed below said second predetermined value; and control means responsive to said first signal from said first signal generator means for generating said fuel-cut signal and further responsive to said second signal from said second signal generating means for terminating the generation of said fuel-cut signal.

14. An electronic controlled fuel injection system according to claim 13, wherein said first signal generating means comprises:

converter means responsive to said fuel injection control circuit for providing a signal indicative of the speed of said engine;

a first engine speed reference circuit operative to generate a first reference signal indicative of said first predetermined engine speed value; and a first comparator circuit responsive to said first reference signal and said signal indicative of engine speed from said converter means for producing said first signal when the engine speed is higher than said first predetermined value established by said first engine speed reference circuit; and said second signal generating means comprises:

a second engine speed reference circuit operative to generate a second reference signal indicative of said second predetermined engine speed value; and a second comparator circuit responsive to said second reference signal and said signal indicative of engine speed from said converter means for providing said second signal when the engine speed is lower than said second predetermined value established by the second engine speed reference circuit.

15. An electronic controlled fuel injection system according to claim 14, wherein said first engine speed reference circuit is a function generator associated with an engine coolant temperature sensor for providing a signal indicative of said first reference engine speed value decreasing with the increase in engine temperature and said second engine speed reference circuit is a function generator associated with said engine coolant temperature sensor for providing a signal indicative of said second reference engine speed value decreasing with the increase in engine temperature.

16. An electronic controlled fuel injection system according to claim 12, wherein said fuel injection valves are split into first and second groups and which further comprises a second fuel-cut signal generator responsive to the control signal from said deceleration signal generator for providing a fuel-cut signal when the engine speed is above a third predetermined value and for terminating said fuel-cut signal when the engine speed is below a fourth predetermined value lower than said third predetermined value; and second switch means responsive to said fuel-cut signal from said second fuel-cut signal generator for disconnecting said fuel injection control circuit from said first group of fuel injection valves.

17. An electronic controlled fuel injection system according to claim 16, wherein said second fuel-cut signal generator includes:

a third signal generating means for generating a third signal indicative of an engine speed above said third predetermined value;

fourth signal generating means for generating a fourth signal indicative of an engine speed below said fourth predetermined engine speed; and second control means responsive to said third signal from said third signal generator means for generating said fuel-cut signal and further responsive to said fourth signal from said fourth signal generating means for terminating the generation of said fuel-cut signal.

18. An electronic controlled fuel injection system according to claim 17, wherein said third signal generating means comprises:

second converter means responsive to said fuel injection control circuit for providing a signal indicative of the speed of said engine;

a third engine speed reference circuit operative to generate a third reference signal indicative of said third predetermined engine speed value; and a third comparator circuit responsive to said first reference signal and said signal indicative of engine speed from said second converter means for producing said third signal when the engine speed is higher than said third predetermined value established by said third engine speed reference circuit and said fourth signal generating means comprises:

a fourth engine speed reference circuit operative to generate a fourth reference signal indicative of said fourth predetermined engine speed value; and a fourth comparator circuit responsive to said fourth reference signal and said signal indicative of engine speed from said converter means for providing said fourth signal when the engine speed is lower than said fourth predetermined value established by the fourth engine speed reference circuit.

19. An electronic controlled fuel injection system according to claim 18, wherein each of said third and fourth engine speed reference circuits is adapted to provide a constant reference value.

20. An electronic controlled fuel injection system for use in an automotive vehicle including a transmission, a foot brake, an internal combustion engine having a throttle valve, a plurality of fuel injection valves, said system comprising, in combination:

(a) a fuel injection control circuit timed to rotation of said engine for providing a drive pulse signal having a frequency corresponding to the speed of rotation of said engine to said fuel injection valves so as to provide a predetermined inlet air/fuel ratio;

(b) a first sensor for providing a signal when said throttle valve is in its closed position;

(c) a second sensor for providing a signal when said foot brake is depressed except when said transmission is in its neutral position;

(d) a deceleration signal generator for generating a deceleration signal when at least one of the signals occurs from said first and second sensors;

(e) a fuel-cut signal generator responsive to the control signal from said deceleration signal generator for providing a fuel-cut signal when the engine speed is above a first predetermined value as well as when the engine speed is above a third predetermined value lower than said first predetermined engine speed value during the application of braking and for terminating said fuel-cut signal when the engine speed is below a second predetermined value lower than said third predetermined engine speed value; and (f) switch means responsive to said fuel-cut signal for disconnecting said fuel injection control circuit from said fuel injection valves.

21. An electronic fuel injection system according to claim 20, wherein said fuel-cut signal generator includes:

first signal generating means for generating a first signal when the engine speed is above said first predetermined value as well as when the engine speed is above said third predetermined value during the application of braking;

second signal generating means for generating a second signal indicative of an engine speed below said second predetermined value; and control means responsive to said first signal from said first signal generator means for generating said fuel-cut signal and further responsive to said second signal from said second signal generating means for terminating the generation of said fuel-cut signal.

22. An electronic controlled fuel injection system for use in an automotive vehicle including a transmission, a foot brake, an internal combustion engine having a throttle valve, and a plurality of fuel injection valves, said system comprising, in combination:

(a) a fuel injection control circuit timed to the rotation of said engine for providing a drive pulse signal having a frequency corresponding to the speed of rotation of said engine to said fuel injection valves for providing a predetermined inlet air/fuel ratio;

(b) a first sensor for providing a signal when said throttle valve is in its closed position;

(c) a second sensor for providing a signal when said foot brake is depressed;

(d) a third sensor for providing a signal when said foot brake is depressed except when said transmission is in its neutral position;

(e) a deceleration signal generator for generating a deceleration signal when at least one of the signals occurs from said first and third sensors;

(f) a fuel cut signal generator responsive to the deceleration signal from said deceleration signal generator for providing a fuel-cut signal when the engine speed is above a first predetermined engine speed value as well as above a third predetermined engine speed value lower than said first predetermined engine speed value during the application of braking and for terminating said fuel-cut signal when the engine speed is below a second predetermined engine speed value lower than said third predetermined engine speed value; and comprising:

(i) converter means responsive to said fuel injection control circuit for providing a signal indicative of the speed of said engine;

(ii) a first engine speed reference circuit operative to generate a first reference signal indicative of said first predetermined engine speed value;

(iii) a first comparator circuit responsive to said first reference signal and said signal indicative of engine speed from said converter means for providing a signal when the engine speed is higher than said first predetermined engine speed value established by said first engine speed reference circuit;

(iv) A third engine speed reference circuit operative to generate a third reference signal indicative of said third predetermined engine speed value;

(v) a third comparator circuit responsive to said third reference signal and said signal indicative of engine speed from said converter means for providing a signal when the engine speed is higher than said third predetermined value established by said third engine speed reference circuit;

(vi) a first AND logic circuit having inputs from said third comparator circuit and said second sensor;

(vii) a second AND logic circuit having an input from said first comparator circuit and an additional input from said second sensor through an inverter;

(viii) an OR logic circuit responsive to at least one of the signals from said first and second AND logic circuits for providing a first signal;

(ix) a second engine speed reference circuit operative to generate a second reference signal indicative of said second predetermined engine speed value;

(x) a second comparator circuit responsive to said second engine speed reference signal and said signal indicative of engine speed from said converter means for providing a second signal when the engine speed is lower than said second predetermined value established by the second engine speed reference circuit;

(xi) and control means responsive to said first signal from said OR logic circuit for generating said fuel-cut signal and further responsive to said second signal from said second comparator circuit for terminating the generation of said fuel-cut signal; and (g) switch means responsive to said fuel-cut signal for controlling application of said drive pulse signal of said fuel injection control circuit to said fuel injection valves.

23. An electronic controlled fuel injection system according to claim 22, wherein said first, second and third engine speed reference circuits are function generators associated with an engine coolant temperature sensor for providing signals indicative of said first, second and third reference engine speed values decreasing with the increase in engine temperature, respectively.

24. An electronic controlled fuel injection system for use in an automotive vehicle including a transmission, a foot brake, an internal combustion engine having a throttle valve, and a plurality of fuel injection valves split into first and second groups, said system comprising, in combination:

(a) a fuel injection control circuit timed to the rotation of said engine for providing a drive pulse signal having a frequency corresponding to the speed of rotation of said engine to said fuel injection valves for providing a predetermined inlet air/fuel ratio;

(b) a first sensor for providing a signal when said throttle valve is in its closed position;

(c) a second sensor for providing a signal when said foot brake is depressed except when said transmission is in its neutral position;

(d) a deceleration signal generator for generating a deceleration signal when at least one of the signals occurs from said first and second sensors;

(e) a first fuel-cut signal generator responsive to the signal from said deceleration signal generator for providing a fuel-cut signal when the engine speed is above a first predetermined engine speed value as well as above a third predetermined engine speed value lower than said first predetermined engine speed value during the application of braking and for terminating said fuel-cut signal when the engine speed is below a second predetermined engine speed value lower than said third predetermined engine speed value;

(f) first switch means responsive to said fuel-cut signal for controlling application of said drive pulse signal of said fuel injection control circuit to said fuel injection valves;

(g) a second fuel-cut signal generator responsive to the control signal from said deceleration signal generator for providing a fuel-cut signal when the engine speed is above a fourth predetermined engine speed value and for terminating said fuel-cut signal when the engine speed is below a fifth predetermined engine speed value lower than said fourth predetermined engine speed value; and (h) second switch means responsive to said fuel-cut signal from said second-fuel signal generator for controlling application of said drive pulse signal of said fuel injection control circuit from said first switch means to said first group of fuel injection valves.

25. An electronic controlled fuel injection system according to claim 24, which further comprises a temperature sensor for preventing the closure of said second switch means when the engine temperature is below a predetermined value.

26. An electronic controlled fuel injection system according to claim 24, wherein said second fuel-cut signal generator comprises a first signal generator for generating a first signal when the engine speed is above said fourth predetermined value, a second signal generator for generating a second signal when the engine speed is below said fifth predetermined value, and control means responsive to said first signal from said first signal generator for generating said fuel-cut signal and further responsive to said second signal from said second signal generator for terminating the generation of said fuel-cut signal.

27. An electronic controlled fuel injection system according to claim 26, wherein said first signal generator comprises a first engine speed reference circuit operative to generate a signal indicative of said fourth predetermined engine speed value, a first comparator circuit responsive to said signal indicative of said fourth predetermined engine speed value and said signal indicative of engine speed from said converter means for producing said first signal when the engine speed is higher than said fourth predetermined engine speed value established by said first engine speed reference circuit, and wherein said second signal generator comprises a second engine speed reference circuit operative to generate a signal indicative of said fifth predetermined engine speed value, and a second comparator circuit responsive to said signal indicative of said fifth predetermined engine speed value and said signal indicative of said engine speed from said converter means for producing said second signal when the engine speed is lower than said fifth predetermined engine speed value established by said second engine speed reference circuit.

28. An electronic controlled fuel injection system according to claim 27, wherein each of said first and second engine speed reference circuits is adapted to provide a constant reference value.

* * * * *